US008177297B2

(12) United States Patent
Powell et al.

(10) Patent No.: US 8,177,297 B2
(45) Date of Patent: May 15, 2012

(54) HIGH CHAIR

(75) Inventors: David Hillary Powell, London (GB); Matthew Peter Tidnam, London (GB)

(73) Assignee: Seymour—Pouell Limited, London (GB)

( * ) Notice: Subject to any disclaimer, the term of this patent is extended or adjusted under 35 U.S.C. 154(b) by 38 days.

(21) Appl. No.: 12/663,846

(22) PCT Filed: Jun. 25, 2008

(86) PCT No.: PCT/GB2008/002167

§ 371 (c)(1), (2), (4) Date: Dec. 10, 2009

(87) PCT Pub. No.: WO2009/004298

PCT Pub. Date: Jan. 8, 2009

(65) Prior Publication Data

US 2010/0171345 A1 Jul. 8, 2010

(30) Foreign Application Priority Data

Jul. 3, 2007 (GB) ..... 0712821.8

(51) Int. Cl.
*A47B 83/02* (2006.01)
*A47D 13/00* (2006.01)
*A47D 15/00* (2006.01)

(52) U.S. Cl. ..... 297/148; 297/149; 297/150; 297/153; 297/154; 297/174 R; 297/467

(58) Field of Classification Search ..... 297/148, 297/149, 150, 151, 153, 154, 155, 174 R, 297/467
See application file for complete search history.

(56) References Cited

U.S. PATENT DOCUMENTS

| | | | | | |
|---|---|---|---|---|---|
| 1,259,604 | A | * | 3/1918 | Cook | 297/467 X |
| 1,556,622 | A | | 10/1925 | Meharey | |
| 2,516,801 | A | | 7/1950 | Renaud | |
| 2,532,812 | A | | 12/1950 | Huber | |
| 2,542,480 | A | * | 2/1951 | Cramer et al. | 297/423.38 X |
| 2,630,164 | A | | 3/1953 | Finwall | |
| 2,850,077 | A | * | 9/1958 | Dawson | 297/423.19 X |
| 3,185,521 | A | * | 5/1965 | Waldo | 297/153 |
| 3,278,229 | A | * | 10/1966 | Bates | 297/423.38 X |
| 3,294,440 | A | * | 12/1966 | Broder | 297/150 |
| 3,632,162 | A | * | 1/1972 | Trethaway | 297/149 |
| 3,642,320 | A | * | 2/1972 | Ward | 297/423.38 X |
| 3,891,270 | A | * | 6/1975 | Crossman et al. | 297/423.1 X |
| 4,148,524 | A | * | 4/1979 | Guyton | 297/423.38 X |
| 4,422,658 | A | * | 12/1983 | Hilliard | 297/467 X |
| 4,819,988 | A | * | 4/1989 | Hellstrom | 297/467 |
| 5,507,550 | A | | 4/1996 | Maloney | |
| 5,527,090 | A | | 6/1996 | Cone | |
| 5,547,253 | A | * | 8/1996 | Schwartz et al. | 297/338 |
| 5,782,532 | A | * | 7/1998 | Opsvik | 297/423.38 X |
| 6,089,666 | A | | 7/2000 | Rosko | |

(Continued)

*Primary Examiner* — Rodney B White

(57) ABSTRACT

There is provided a high chair (1) for seating of an infant or toddler comprising a seat (10), including a seat base portion (14) and a seat backrest portion (12); a support (20) for supporting the seat (10) in a raised position relative to a floor surface; a central post (30) projecting away from the sea base portion (14) and having an upper end; and mounting to the upper end of the central post (30), a tray assembly. (40) including a tray (42) laterally movable backwards and forwards relative to the seat (10). The central post (30) mounts to the seat (10) or to the support (20) by an adjustable central post mounting (32) that allows for adjustment of the position of the upper end of the central post (30) relative to the seat (10).

42 Claims, 13 Drawing Sheets

U.S. PATENT DOCUMENTS

| | | | | |
|---|---|---|---|---|
| 6,149,239 | A * | 11/2000 | Markussen et al. | 297/423.19 X |
| 6,416,124 | B1 | 7/2002 | Chen et al. | |
| 6,648,417 | B1 * | 11/2003 | Gilbert et al. | 297/423.19 X |
| 6,761,339 | B2 * | 7/2004 | Minami | 297/344.19 X |
| 7,185,949 | B2 * | 3/2007 | Finell | 297/148 |
| 7,367,618 | B2 * | 5/2008 | Rossini | 297/153 X |
| 7,651,168 | B2 * | 1/2010 | Kelly | 297/153 X |
| 7,673,942 | B2 * | 3/2010 | Tuckey et al. | 297/344.22 |
| 7,905,549 | B2 * | 3/2011 | Lake et al. | 297/153 X |
| 2007/0029847 | A1 | 2/2007 | Finell | |
| 2007/0145790 | A1 | 6/2007 | Ventrola | |
| 2007/0163846 | A1 | 7/2007 | Finell | |
| 2008/0179923 | A1 | 7/2008 | Lake et al. | |

* cited by examiner

HIGH CHAIR

TECHNICAL FIELD

The present invention relates to a high chair for an infant or toddler that provides for ease of placing and retaining the infant or toddler therein.

BACKGROUND TO THE INVENTION

High chairs designed for use by infants or toddlers are well known in the prior art. Such seats are typically designed to provide a safe and secure raised seating for the infant or toddler, and are recognized to be of particular utility at mealtimes. Typically, high chairs include a raised seat; means for retaining the infant or toddler in the raised seat; and a tray located forward of the raised seat.

The means for retaining the infant or toddler ('child') in the seat conventionally comprises a harness and/or one or more retaining bars such as one that locates laterally between arm rests of the raised seat. One problem that can arise with such retaining means is in preventing the child from sliding down the seat. Another problem relates to the ease of placing the child in the raised seat and applying the harness or indeed, in releasing the harness when removing the child from the raised seat. Many infants or toddlers dislike the sense of being 'tethered in' and will wriggle, squirm and squeal to resist this. For the parent or carer, simple means of retaining the child are therefore preferable.

Applicant has appreciated that means for retaining the toddler of infant may be provided in combination by a central post projecting up from the front part of the seat base of the raised seat and a laterally (i.e. backwards and forwards) movable tray provided to the top of that central post. In use, the tray is first moved forwards (i.e. laterally away from the seat back) to create a space through which the infant or toddler may be placed into the raised seat with one leg on either side of the central post. The tray is then moved backwards to a position, in which the rear of the tray locates close to the infant or toddler's trunk (i.e. stomach, midriff or chest) and acts in combination with the central post to retain the infant or toddler in this retaining position. The infant or toddler cannot slide down in the seat because of the presence of the central post. To remove the infant or toddler, the tray is simply moved forwards to the unloading position.

Applicant has now realized that use of such a central post/movable tray retaining set-up is facilitated by ease of tray movement from the unloading to retaining positions and vice-versa. In embodiments, the high chair herein allows for spring-assisted tray movement (e.g. spring-release) with the minimum of user steps and effort, which is highly advantageous in situations where the parent or carer is conducting those steps whilst also holding a wriggling, squirming or screaming child.

Applicant has also realized that such central post/movable tray retaining set-ups can give rise to a problem in that the optimum retaining position (i.e. defined in combination by post and tray position) will vary with the size of the child. Applicant has therefore recognized that it is advantageous for variation of that retaining position to be provided both in terms of height and lateral spacing of the tray from the raised seat. In embodiments, the high chair herein provides for that 'tailoring' of child retaining position. Applicant has also found that since the high chair herein enables for optimum 'tailoring' of the child retaining position distinct arm rest need not necessarily be provided to the seat.

U.S. Pat. No. 5,507,550 describes a high chair for an infant or toddler that includes a seat element, a frame assembly for supporting the seat element on a supporting surface, and a feeding tray assembly on the seat element. The feeding tray assembly includes a centre support and retaining post which is secured to the front centre portion of the seat element and a tray element which is adjustably secured to the upper end of the centre support and retaining post. The centre support and retaining post is operative for preventing a child from sliding downwardly between the seat element and the tray element. No spring-assisted tray release or variability of height of the tray element is provided by this high chair, which also requires distinct arm rests.

It is an object of the present invention to provide a high chair for an infant or toddler that provides for ease of retaining of the infant or toddler therein.

SUMMARY OF THE INVENTION

According to a first aspect of the present invention there is provided a high chair for seating of an infant or toddler comprising a seat, said seat including a seat base portion and a seat backrest portion;

a support for supporting the seat in a raised position relative to a floor surface;

a central post projecting away from said seat base portion, said central post having an upper end; and mounting to said upper end of the central post, a tray assembly including a tray laterally movable backwards and forwards relative to the seat, wherein the central post mounts to the seat or to the support by an adjustable central post mounting that allows for adjustment of the position of the upper end of the central post relative to the seat.

Herein, the terms 'backwards' and 'forwards' are relative to the normal seating position of the child in the seat. Thus, 'forwards' means the direction extending out laterally (i.e. horizontally) from the seat backrest and backwards is the opposite direction. Herein, the terms 'upwards' and 'downwards' are relative to the plane defined by the floor surface. Thus, 'upwards' means in a vertical direction relative to the floor surface and downwards is the opposite direction towards the floor surface.

There is provided a high chair for seating of an infant or toddler ('child'). Typically, the child is aged from six months to five years, and one advantage of the present seat is that it allows for accommodation of children of a range of ages because of the adjustability of child retaining position that it provides for.

The high chair comprises a seat arranged for seating of the child. The seat includes a seat base portion for receipt of the seated child's buttocks/upper thighs and a seat backrest portion for support of the seated child's back. In embodiments, the seat is of conventional form with a generally planar seat base and seat backrest extending generally upwards from a back edge thereof. In other embodiments the seat has a shell or 'bucket' seat form, it being appreciated that such seat forms also define a seat base portion and seat backrest portion, typically in an integral (e.g. moulded) overall seat form. Optionally, the seat is provided with a harness although, it is a feature of the high chair herein that a harness is not necessary for restraint of the seated infant or toddler.

The high chair also comprises a support for supporting the seat in a raised position relative to a floor surface. The floor surface is generally a planar surface such as may be found in a kitchen or dining room in normal use of the high chair. The support may have any suitable form that allows for stable support of the seat in the raised position.

In embodiments, the support is defined by a frame structure provided with supporting legs (e.g. four legs) that connect in use, with the floor surface. In other embodiments, the support is defined by a central upright support column that is provided at its lower end with a column base arranged for stable supporting contact with the floor surface.

In embodiments, the column base defines a planar support surface (e.g. a pad). In other embodiments, the column base defines a support ring (e.g. circular or ovular) or indeed, is provided with plural legs, feet or castors.

In embodiments, the seat is in fixed relationship to the support. In other embodiments, the seat is in movable relationship to the support such as provided by a rotation mounting (e.g. rotation by +/−90° from the 'facing front' position) or slide mounting there between. In embodiments, the mounting includes a biasing mechanism for biasing the seat to a 'rest position' (e.g. to a non-rotated position). Where the seat is movable relative to the support a seat lock mechanism (e.g. catch or latch) is provided to enable reversible locking of that movement.

In embodiments, the support provides for upwards and downwards movement of the seat relative to the floor surface. In embodiments, the support includes an extension mechanism that allows reversible extension of that support to allow for the upwards/downwards movement. In other embodiments, the support is defined by a central upright support column that is provided at its lower end with a column base arranged for stable supporting contact with the floor surface, and that support column has telescopic form such that it is telescopically extendable. Necessarily, where the support provides for upwards and downwards seat movement there is provided a support lock mechanism (e.g. catch or latch) to enable reversible locking of that movement. In embodiments, a control mechanism may also be provided to control the upwards/downwards movement and possibly to provide mechanical, pumped or propelled advantage. Thus, in one example a telescopic support column is provided with a gas strut or pump for providing pumped gas propulsion to assist with the upwards movement thereof.

In embodiments, the support is provided at its lower end with transport means for transporting the lower end (e.g. legs or support base) thereof along the floor surface. Thus, in embodiments one or more sliders, rollers, wheels or castors are provided as transport elements to the lower end of the support. Applicant has appreciated that it is desirable that when the child is seated the support should not be transportable along the floor surface. The transport means may therefore be provided with retraction means arranged such that the transport elements are reversibly retractable from a contact position in which they make contact with the floor surface (and hence, enable transport) to a retracted position in which contact with the floor surface is prevented (e.g. there is space there between) or hindered. Alternatively, the transport means are simply provided with a brake that acts to stop transport movement when engaged and allows transport movement when engaged. In embodiments, the brake means comprise one or more fixed feet that contact the floor surface during normal use of the chair, and which braking contact must be broken (e.g. by lifting or tipping up the chair) to enable transport thereof. In embodiments, the retraction means and/or brake means are arranged such as to prevent transport movement when downward force (e.g. the weight of the child) is applied to the seat and to allow such transport movement in the absence of such downward force.

In embodiments, the brake means is provided by a compressible rubber skirt provided to the periphery of the column base. In the absence of downward force, the rubber skirt is in a non-compressed state and provides no braking. In the presence of downward force however, the rubber skirt is compressed down and provides frictional braking, which acts to prevent transport movement.

The high chair comprises a central post projecting away from the seat base portion. Preferably, the central post projects both forwardly (e.g. at an angle of from 45° to 75° from the vertical) from the seat base portion. The central post has an upper end. In embodiments, the central post mounts to the seat. In other embodiments, the central post mounts to the support. In either case, the central post projects away (e.g. forwardly and/or upwardly) from the seat base such that when a child is received by the seat the child's legs are accommodated one either side of the central post with typically each of the child's thighs resting alongside the central post.

The central post may be defined by a linear post, but more typically is defined by a post of curving form (e.g. 'S' shaped) wherein that curving form allows for effective projection away (e.g. in a forwards and upwards sense) from the seat base portion. For child comfort, the post is typically provided with rounded edges or is of a generally cylindrical form defining a circumferential outer surface.

There is provided mounting to the upper end of the central post, a tray assembly that includes a tray laterally movable backwards and forwards relative to the seat. The tray generally defines a back edge that in use, rests closest to the child and which in embodiments has a curved form the purpose of which will become clearer from the later description.

The function of the tray herein may be two-fold. Firstly and conventionally, it provides a tray surface arranged for receipt of tableware, cutlery, foodstuffs and so on as are to be made available to the feeding toddler or infant. Secondly and unconventionally, the tray in combination with the central post provides means for retaining the child within the seat. In this second and unconventional aspect, the tray is laterally movable from a first child receiving position to a second child retaining position. In the first child receiving position the tray is moved laterally forwards (i.e. in the direction away from the seat) such as to define sufficient space between the seat, central post and back edge of the tray for placing of the child in a seated position in the seat. In the second child retaining position the tray is moved laterally backwards (i.e. in the direction towards the seat) such as to sufficiently reduce the space between the seat, central post and back edge of the tray that the child is retained in its seated position in the seat. Typically, in this child retaining position the back edge of the tray locates close to (e.g. comfortably up against) the trunk (i.e. stomach, midriff or chest) of the child such as to prevent the child wriggling or climbing out from the seat.

In embodiments, the tray assembly comprises a slide mounting (e.g. track and rail mounting) for slidably mounting the tray to the upper end of the central support post, wherein sliding movement is thereby enabled in the backwards and forwards direction as described above.

In other embodiments, the tray assembly comprises a fixed mounting for fixedly mounting a tray support to the upper end of the central support post, and that tray support is provided with a slide mounting for slidably mounting the tray thereto. This latter arrangement is typically more stable that direct slide mounting of the tray to the central support post.

Typically, the slide mounting for the tray is provided with a tray lock mechanism (e.g. catch or latch) to enable reversible locking of that sliding movement. Preferably, the tray lock mechanism enables locking of the tray in the child retaining position and optionally may also enable locking of the tray in the child receiving position.

In embodiments, the slide mounting for the tray is provided with biasing means for biasing the tray to the child receiving position. The biasing means may comprise one or more compression springs or similar. An advantage of this arrangement is that in use, the user simply unlocks the tray lock mechanism and the tray springs out to or at least, towards the child receiving position, which is particularly convenient for the parent or carer trying to place a child in or remove a child from the seat within the minimum of effort.

In the high chair herein the central post mounts to the seat or to the support by an adjustable central post mounting that allows for adjustment (i.e. movement) of the position of the upper end of the central post relative to the seat. This adjustability of the position of the upper end of the central post relative to the seat will be appreciated to also provide for adjustment of the position of the tray assembly, which mounts to that upper end, and thus of the tray when in the child retaining position. Thus, overall the space provided between the seat, central post and tray edge when the tray is in the child retaining position may be adjusted to 'tailor' for the size of the child and thus also, to accommodate for growth of the child.

In embodiments, the central post mounting comprises a cavity (e.g. cylindrical) provided to the seat. In embodiments, the central post mounting allows for forwards/backwards adjustment of the position of upper end of the central post relative to the seat. In embodiments, the central post mounting allows for upwards/downwards adjustment of the position of upper end of the central post relative to the seat. In preferred embodiments, the central post mounting allows for both upwards/downwards and forwards/backwards (e.g. simultaneously at an angular projection relative to the seat) adjustment of the position of upper end of the central post relative to the seat. In embodiments, the central post extends from the central post mounting at an angle to the vertical, thereby engendering such both upwards/downwards and forwards/backwards adjustability.

Typically, the adjustable central post mounting is provided with a central post lock mechanism (e.g. catch or latch) to enable reversible locking of that adjustment movement.

In embodiments a seat insert (e.g. cushioned, moulded or inflatable) is provided to the seat base portion and/or the seat backrest portion. The seat insert is designed to enhance the child retaining relationship between seat, central post and tray when the tray is in the child retaining position, and thus allow for securing of younger children (e.g. less than one year olds).

In embodiments, a leg rest is provided to the support for supporting the legs of a child when seated in the seat. In embodiments, that leg rest is adjustable to accommodate different lengths of child's legs.

According to another aspect of the present invention there is provided a high chair for seating of an infant or toddler comprising a seat, said seat including a seat base portion and a seat backrest portion;

a support for supporting the seat in a raised position relative to a floor surface;

a central post projecting away from said seat base portion, said central post having an upper end; and mounting to said upper end of the central post, a tray assembly including a tray and a slide mounting for said tray that enables lateral movement of the tray backwards and forwards relative to the seat, wherein said slide mounting for the tray is provided with biasing means for biasing the tray forwards relative to the seat (i.e. laterally away from the seat).

It will be appreciated that all parts of the high chair herein may be manufactured and supplied separately and/or supplied as a kit of parts. The present invention encompasses all of these separate component parts and sub-assemblies thereof.

BRIEF DESCRIPTION OF THE DRAWINGS

The invention will now be described further with reference to the accompanying drawings, in which:

Referring now to the drawings, FIGS. 1*a* to 3 illustrate different views of a high chair 1 herein, which provides for seating of an infant or toddler ('child'). The high chair 1 allows for accommodation of children of a range of ages and sizes because of the adjustability of child retaining position that it provides for.

Figure 1B:
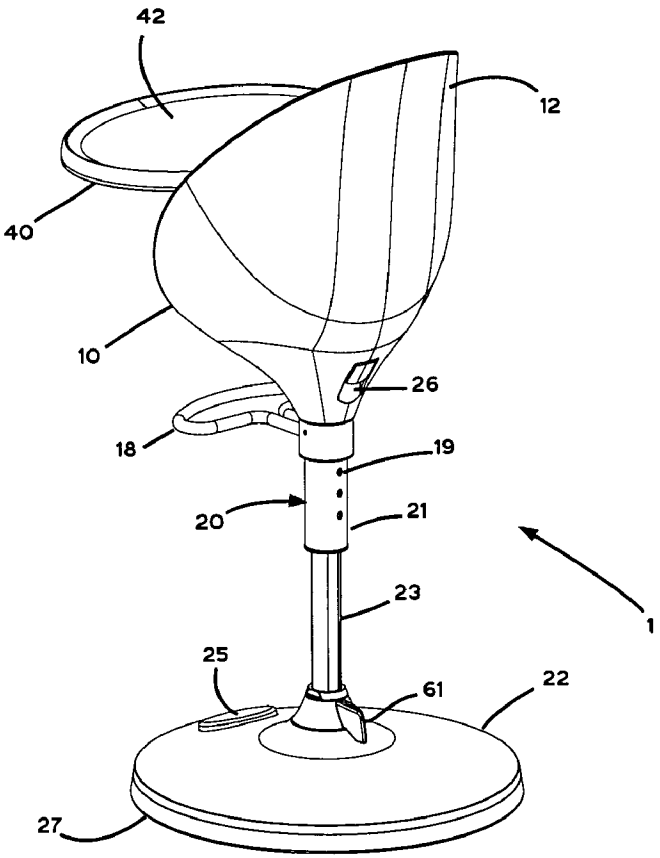
FIGS. 1*a* and 1*b* respectively show offset perspective views from the front and rear of a high chair in accord with the present invention.
Figure 1A:
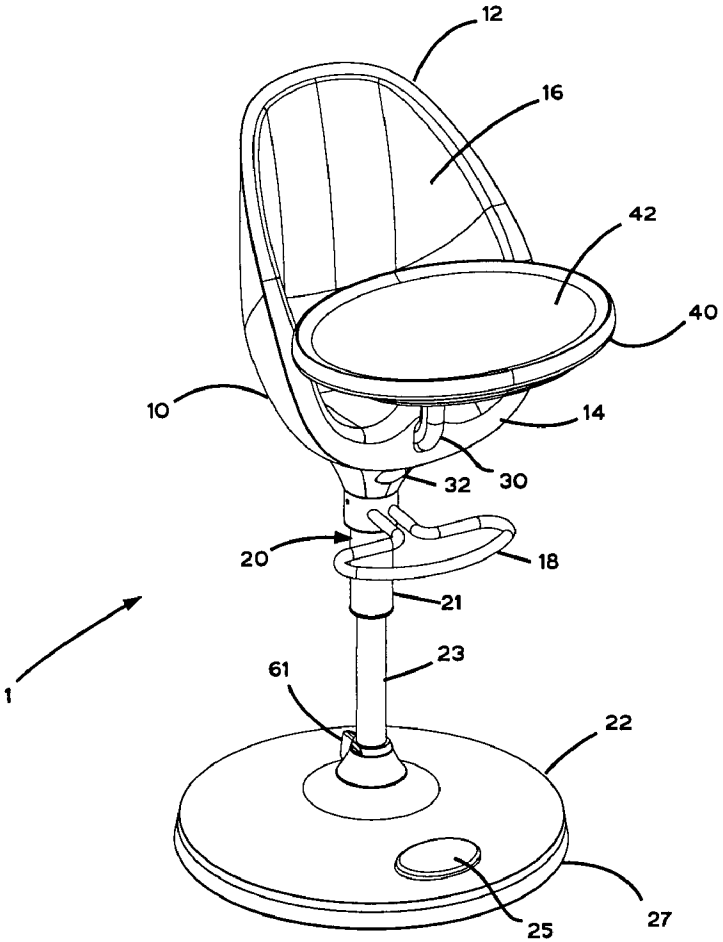
Figure 2C:
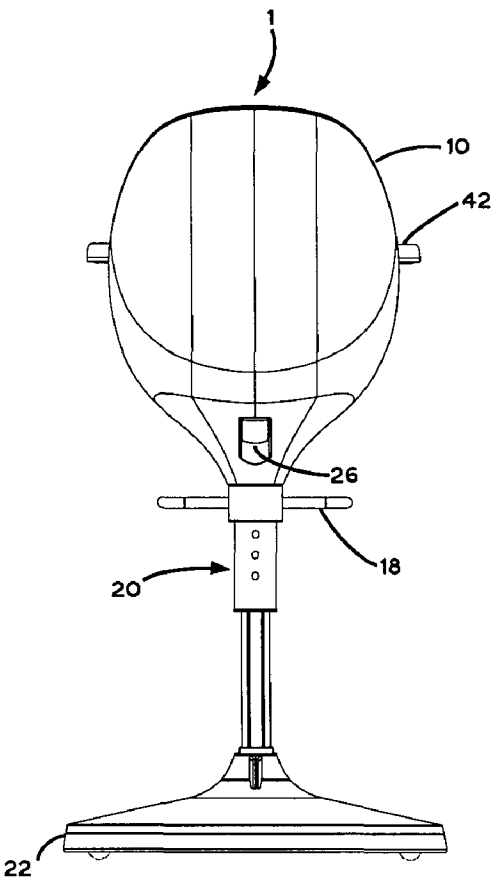
FIGS. 2*a* to 2*e* respectively show side, front, back, top and bottom views of the high chair of FIG. 1.
Figure 2B:
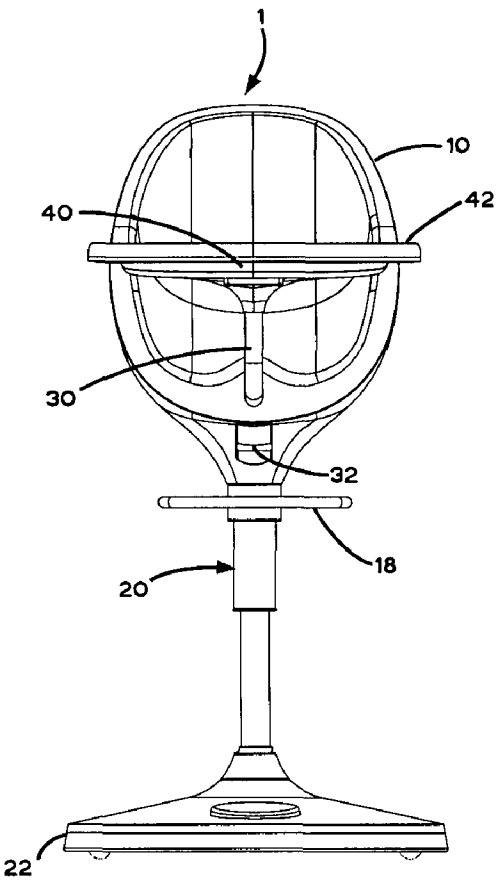
Figure 2A:
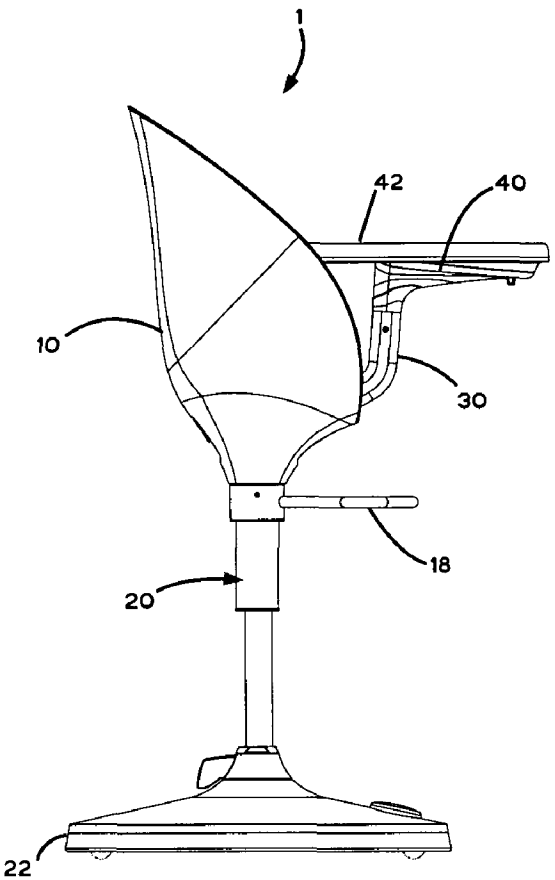
Figure 2D:
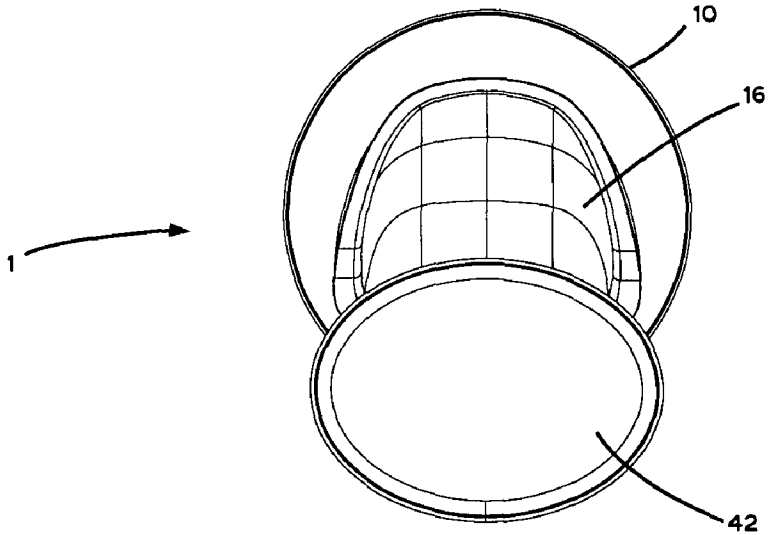
Figure 2E:
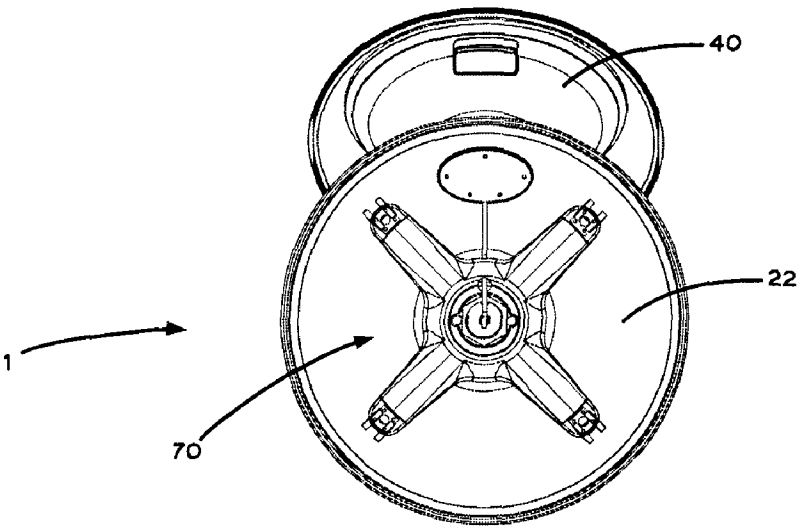
Figure 3:
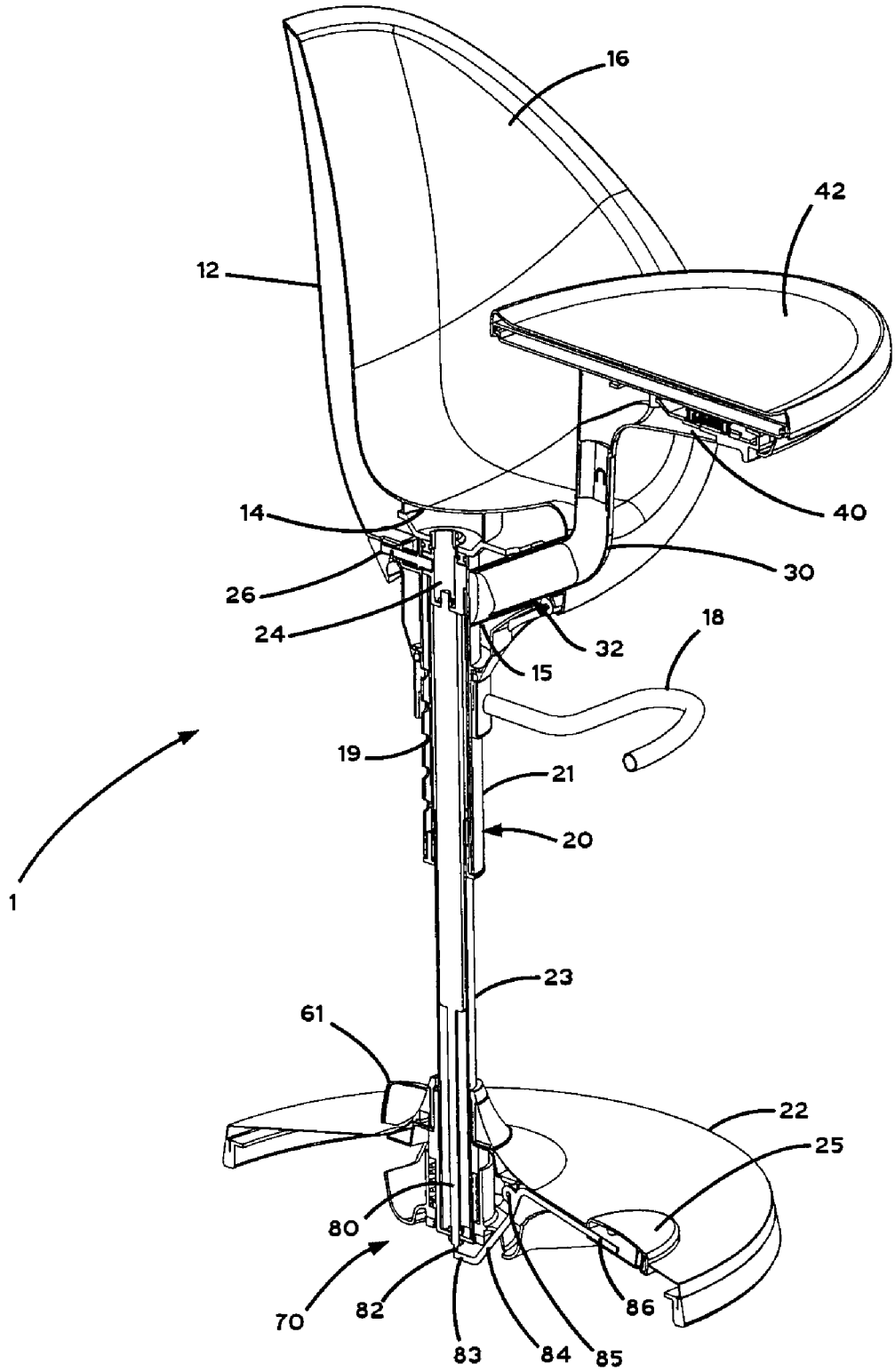
FIG. 3 shows a cut-away view of the high chair of FIG. 1, the cut-away being along the 'sagittal' plane thereof.
Figure 4:
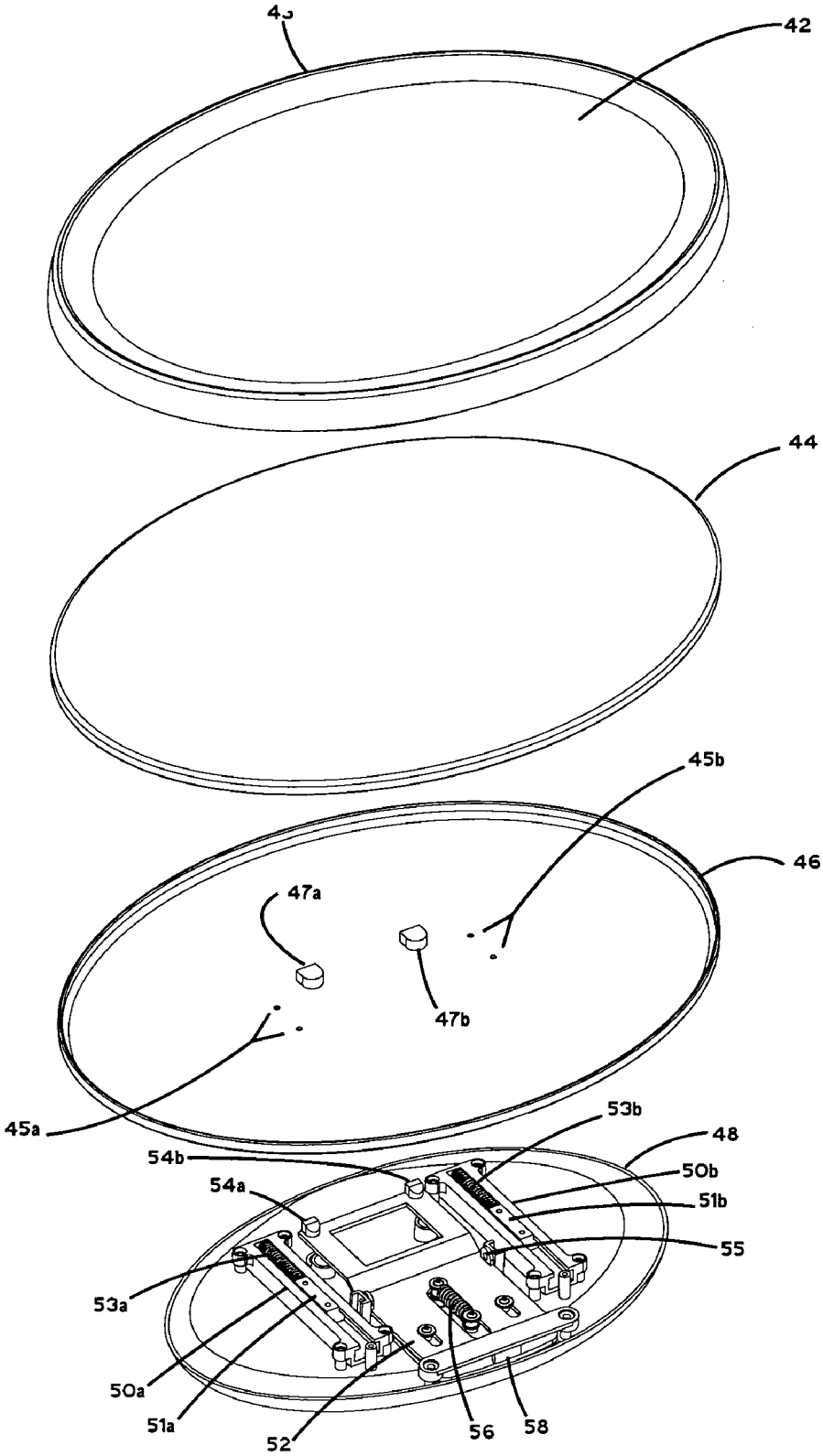
FIG. 4 shows an exploded view of the tray assembly of the high chair of FIG. 1.

Turning now to the drawings, the high chair 1 may be seen to comprise a raised seat 10 of integral 'bucket' form and defining a seat base portion 12 moulded to accommodate the child's buttocks and upper thighs and a seat backrest portion 14. A seat insert 16 is provided to the seat base portion 12 and seat backrest portion 14 for better accommodation of the child. The seat insert 16 may be removed to 'enlarge' the child seating area as the child grows bigger. The seat 10 mounts to the upper end of upright support column 20 provided with a circular pad base 22, thereby supporting the seat 10 in a raised position relative to a floor surface. An adjustable leg rest 18 movable about peg positions 19 (only one labelled) is provided to the support 20 for supporting the legs of a child when seated in the seat 10.

In more detail, the seat 10 rotatably mounts to the upper end of the upright support column by means of rotational mounting 24 such that the seat 10 may rotate by +/−90°, but in embodiments, is normally biased to the non-rotated position. A seat lock mechanism 26 is further provided to enable reversible locking of the rotational movement of the seat 10 relative to the upright support column 20. The rotational function of the seat 10 relative to upright support column 20 has been found to be of particular utility when placing the child in the seat 10 and also when locating the seat 10 at a position around a kitchen or dining room table.

In another detail, the upright support column 20 may be seen to have telescopically extendable form and to be defined by upper 21 and lower 23 telescopic parts. This telescopic form enables the upright support column 20 to provide for upwards and downwards movement of the seat 10 relative to the floor surface. Telescopic extension is responsive to a gas propelling mechanism responsive to foot pedal 25 locating at the support base 22.

Figure 8:
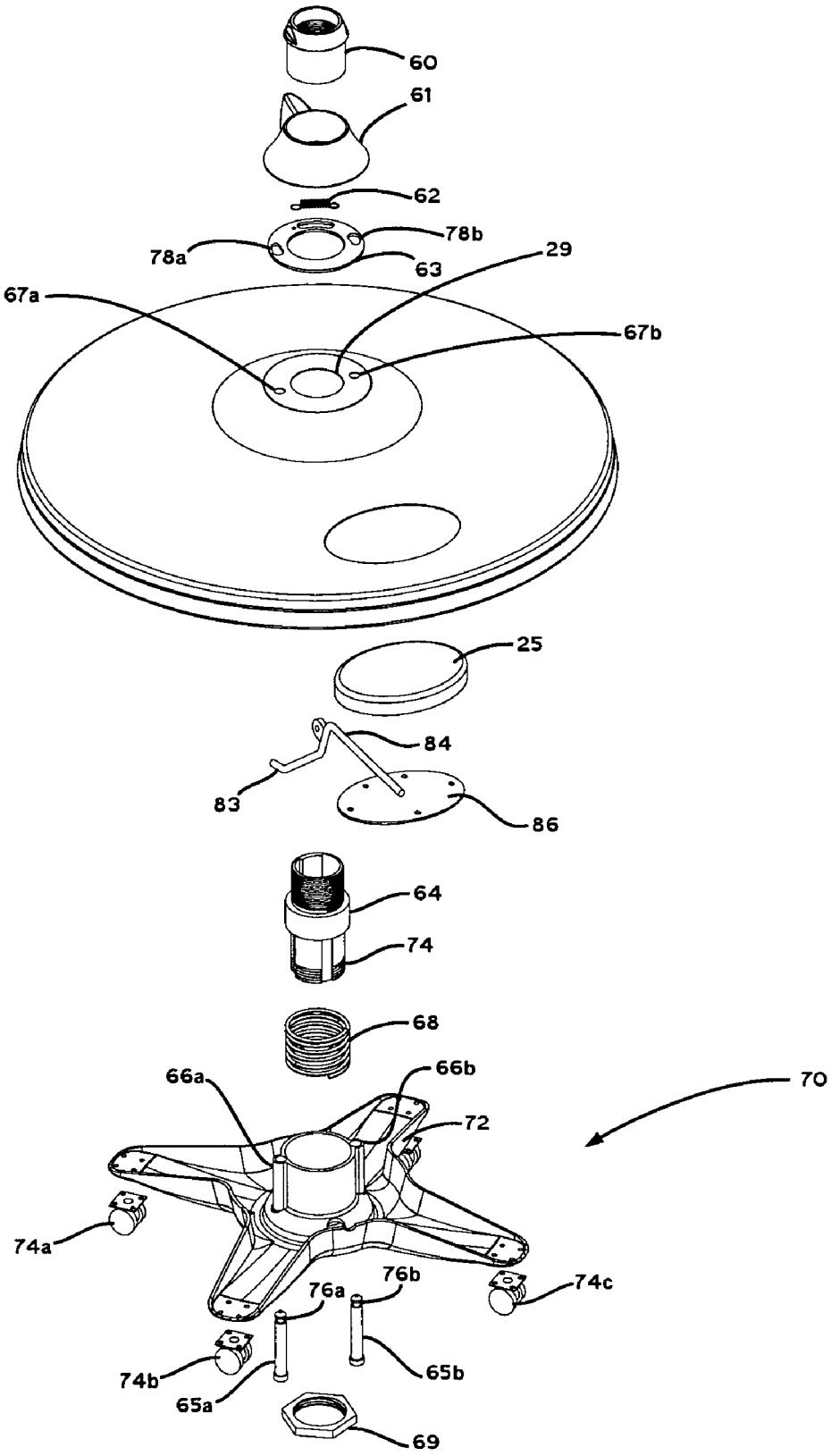
FIG. 8 shows an exploded view of the support base for the central upright support column of the high chair of FIG. 1 together with retractable transport elements thereof and transport lock mechanism therefor.

In more detail, and with reference also to FIG. 8, it may be seen that the telescopic central upright support column 20, 21, 23 is provided with an internally-located gas strut 80 having pip end 82 for control of gas propulsion to assist with telescopic extending movement thereof. That pip end 82 may be actuated in response to pressure applied by lever end 83 of lever 84 that pivots at pivot point 85, wherein the lever 84 provided at its other end with plate 86, which couples to foot pedal 25. Thus, in use the user applies pressure to the foot pedal 25, which is then transferred by the lever 84 to the pip end 82 of the gas strut 80 for propelling the telescopic column 20, 21, 23 upwards.

The seat base portion 14 is provided with a central post 30 projecting away therefrom. The central post 30 has an upper end, to which mounts a tray assembly 40 including a tray 42 that is laterally movable backwards and forwards relative to the seat 10. The central post 30 mounts to the seat base portion 14 by an adjustable central post mounting 32 that allows for adjustment of the position of the upper end of the central post 30 relative to the seat 10.

Figure 7A:
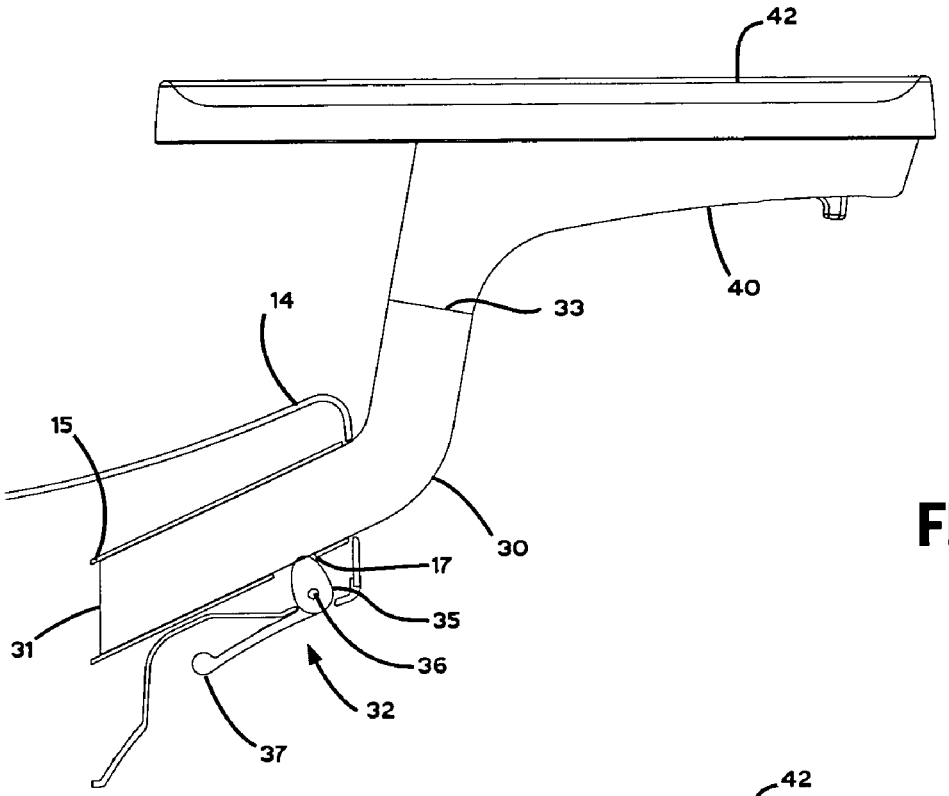
FIGS. 7*a* and 7*b* show sectional views of the central post and adjustable central post mounting of the high chair of FIG. 1 in respectively locked and unlocked configurations.
Figure 7B:
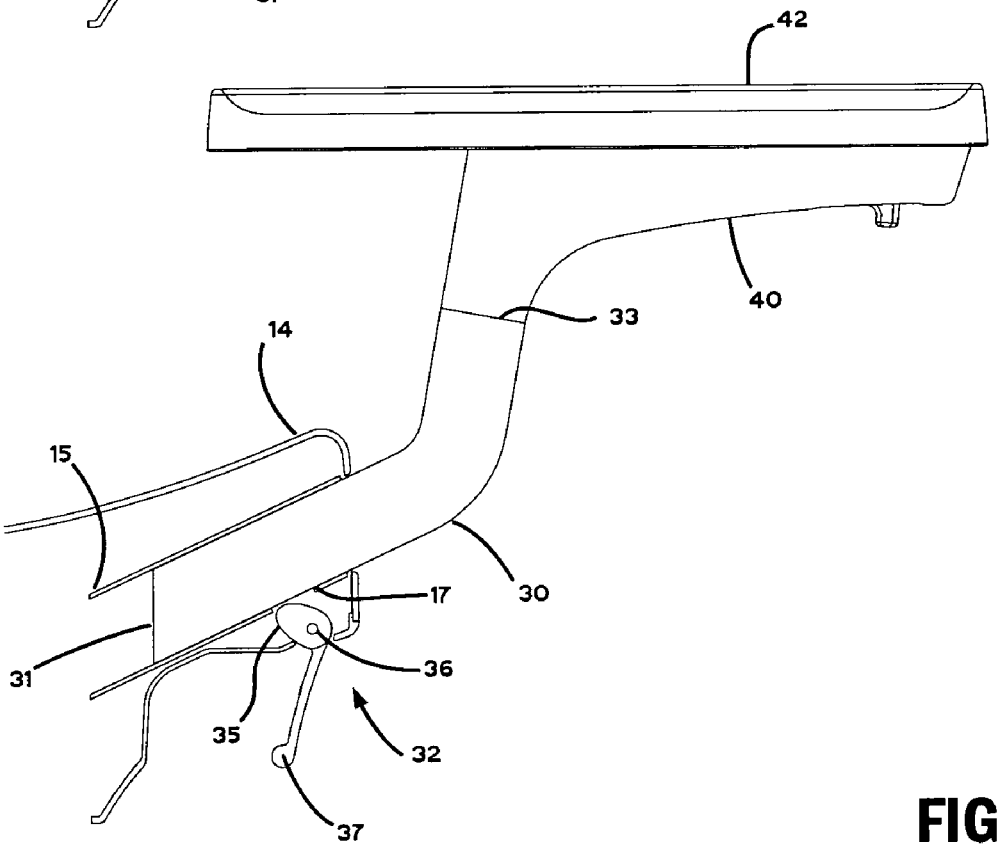

In more detail, and with particular reference now to FIGS. 7*a* and 7*b*, the central post 30 may be seen to have a generally 'S' shaped tubular form and to project both forwardly and upwardly from the seat base portion 14. Tray assembly 40 may be seen to mount to the upper end 33 of the central post 30. The lower end 31 of the central post 30 is received within a cylindrical cavity 15 provided within the seat base portion 14. It will be appreciated that the cylindrical cavity 15 defines a central axis that projects at an angle of approximately 65° from the vertical such that the lower end 31 of the central post 30 also projects out at this angle. It will also be appreciated that movement of the lower end 31 of the central post 30 within this angularly projecting cylindrical cavity 15 allows for adjustment of the position of the upper end 33 of the central post relative to the seat base portion 14. Thus, in more detail, withdrawing the lower end 31 of the central post 30 from the cylindrical cavity moves the upper end 33 and tray assembly 40 locating thereon both upwards and forwards relative to the seat base portion 14.

Movement of the central post 30 within the cylindrical cavity 15 is under the control of a friction lock mechanism comprising a shaped friction head 35 that may extend into the cylindrical cavity 15 through port 17 and is pivotally mounted at pivot point 36 and movable in response to movement of lever 37. In a 'locking' position (see FIG. 7*a*) the friction head 35 frictionally interacts with the lower end 31 of the central post 30 to prevent movement thereof. In an 'unlocked' position (see FIG. 7*b*) the friction head 35 is spaced from and therefore does not frictionally interact with the lower end 31 of the central post, which may then be moved in the cylindrical cavity 15. It may thus, be appreciated that the cylindrical cavity 15 with port 17 and friction lock mechanism 35, 36, 37 in combination act to provide the adjustable mounting 32 for the central post 30.

In normal use of the high chair 1 herein, it is envisaged that adjustment of the central post 30 positioning would not be conducted on a day-to-day basis. Rather, this adjustment, which in essence allows for 'tailoring' of the space provided between the seat 10, central post 30 and tray assembly 40, would be conducted occasionally to accommodate for growth of the child. It will be appreciated that because the central post 30 projects at an angle to the vertical the nature of the adjustment is both upwards and forwards, which matches the pattern of growth of the child. Alternatively, if the high chair 1 is used for another child then this adjustment may be carried out to enable the appropriate 'tailoring' for the size of that child.

In embodiments, the central post 30 and tray assembly 40 carried thereby may be completely removed from the seat 10. A plug (not shown) may be provided to 'plug up' the entry to the cylindrical cavity 15. In this mode of use, the high chair 1 is simply functioning as a chair without any means of restraining the child, and is thus more suitable for an older child who no longer needs restraining in the chair 1.

The function of the tray assembly 40 is now described in more detail with particular reference to FIGS. 4 to 6*b*. Overall, the tray assembly 40 is of generally ovular form and the tray top 42 therefore defines a tray top back edge 43 that in use, locates close to the child seated in the seat 10, which is of curved profile. The tray top 42 is arranged to be reversibly removable (e.g. for ease of cleaning) from under tray 44 upon which in normal use, it sits. In turn, the under tray 44 sits on lower tray 46, which in turn slidably mounts to tray support 48 to which is provided the tray slide adjustment mechanism to be described in more detail. Tray support 48 fixes to the upper end 33 of the central post 30. For safety, the tray slide adjustment mechanism of the tray assembly 40 defines an integral 'sealed unit' housing to prevent a child's fingers being inadvertently inserted therein.

Figure 5A:
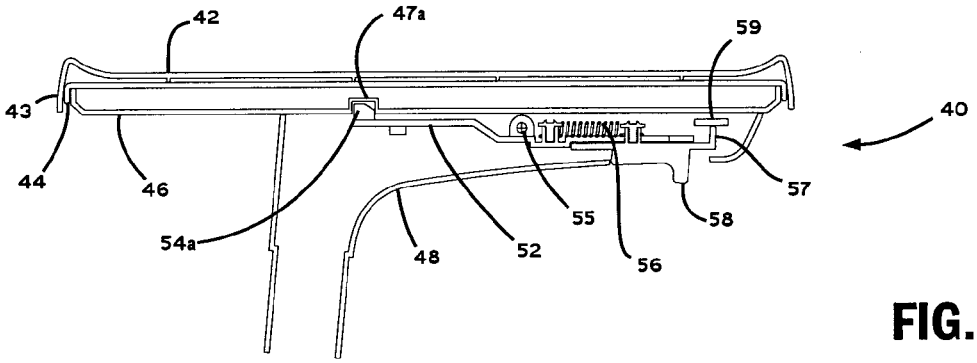
FIGS. 5*a* to 5*c* show sectional views of the tray assembly of FIG. 4 respectively in the 'tray in' and locked position; the 'tray in' and unlocked position; and the 'tray out' position.
Figure 5B:
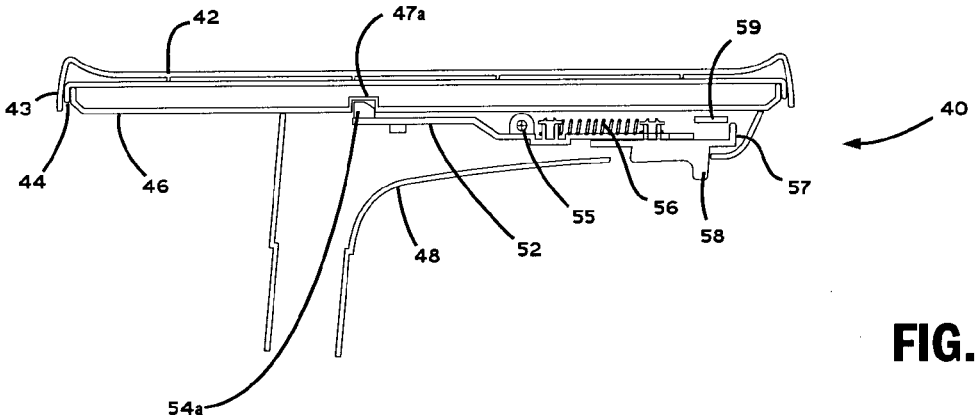
Figure 5C:
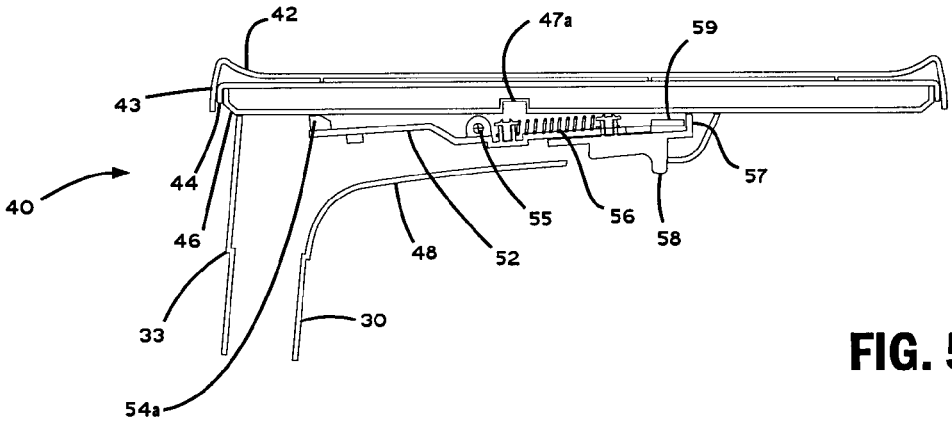
Figure 6A:
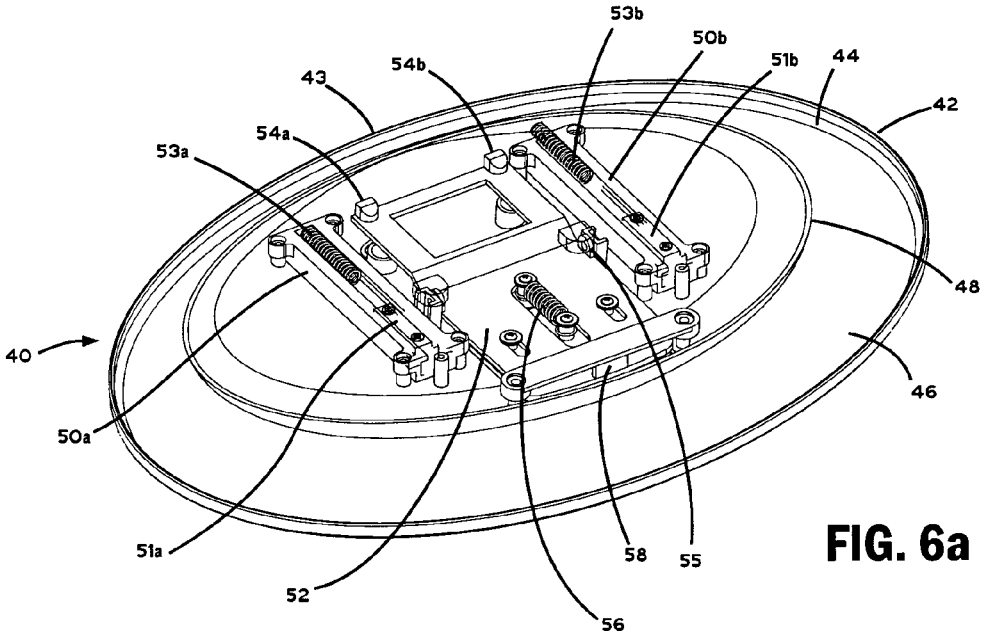
FIGS. 6*a* and 6*b* show perspective views of the underside of the tray assembly of FIG. 4 respectively in the 'tray in' and locked position; and the 'tray out' position.
Figure 6B:
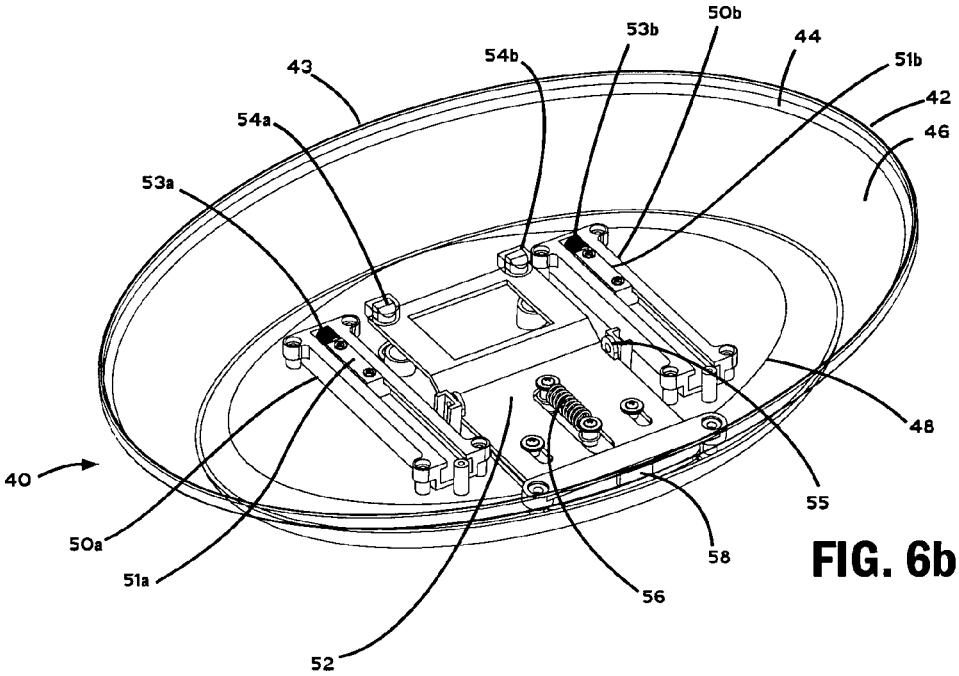

In functional terms, the tray assembly 40 is arranged such that the tray top 42 is laterally movable relative to the seat 10 from a child receiving position (as shown in FIGS. 5*c* and 6*b*), in which the tray top 42 is moved laterally forwards (i.e. 'tray out') such as to define sufficient space between the seat 10, central post 30 and tray top 42 for placing of the child in a seated position in the seat 10, to a child retaining position (as shown in FIGS. 5*a* and 6*a*), in which the tray top 42 is moved laterally backwards (i.e. 'tray in') such as to sufficiently reduce the space between the seat 10, central post 30 and the tray top 42 that the child is retained in its seated position in the seat 10.

To achieve this lateral movement, lower tray 46 slidably mounts to tray support 48 by means of movable carriages 51*a*, 51*b* provided to parallel track mountings 50*a*, 50*b* that screw fix at fixing points 45*a*, 45*b* provided to the lower tray 46. Under tray 44 and tray top 42 sit in fixed lateral relation to the lower tray 46 such that when the lower tray 46 is slidably moved relative to the tray support 48 both the under tray 44 and tray top 42 move in corresponding fashion. The extent of the sliding movement that is possible is in essence determined by the length of the parallel track mountings 50*a*, 50*b* and is selected to meet the need to define the two necessary child receiving and child retaining positions. It will be noted that each carriage 51*a*, 51*b* is biased by the action of compression springs 53*a*, 53*b* to a position as shown at FIGS. 5*c* and 6*b*, in which the lower tray 46 is moved away from the seat 10 (i.e. to the child receiving position).

Control of the sliding movement of the lower tray 46 relative to the tray support 48 is provided by a latch mechanism comprising latch arm 52 pivoted at pivot point 55 and provided with latch heads 54*a*, 54*b* arranged for reversible latching interaction with notches 47*a*, 47*b* provided to the lower tray 46. Free pivoting of the latch arm 52 is normally prevented by the stop interaction of tail end 57 with stop block 59 (see FIGS. 5*a* to 5*c*), which acts as a safety feature. To release that stop interaction and allow for free pivoting of the latch arm 52, the user pulls release trigger 58 against return spring 56 in a direction away from the seat 10 (left to right as shown at FIGS. 5*a* to 5*c*). Once the latch mechanism 52 is released the lower tray 46 (and under tray 44, tray top 42 supported thereby) will be moved to the position as shown at FIGS. 5*c* and 6*b*, in which the lower tray 46 is moved away from the seat 10 (i.e. to the child receiving position) as a result of the biasing action of the compression springs 53*a*, 53*b*.

In a typical use scenario, starting from the 'tray in' position of FIGS. 5*a* and 6*a*, the parent or carer pulls the release trigger 58 against return spring 56 to allow the tail end 57 of the latch arm 52 to move beyond the stop block 59 (see FIG. 5*b*). The latch arm 52 may then be pivoted to allow for de-latching of the latch heads 54*a*, 54*b* from the notches 47*a*, 47*b* of the lower tray 46. That lower tray 46 then experiences the biasing force of the compression springs 53*a*, 53*b* and starts to travel on its carriage mountings 51*a*, 51*b* along the tracks 50*a*, 50*b* towards the 'tray out' position of FIGS. 5*c* and 6*b*. In embodiments, the spring 53*a*, 53*b* force may either be sufficient to carry the lower tray 46 fully to the 'tray out' position or just to start it on its way with the user providing a final push to complete the outwards movement. The child is then placed in the seat 10 of the chair 1 and the tray top 42, under tray 44 and lower tray 46 are pushed in until the latch heads 54*a*, 54*b* again engage in latching fashion with the notches 47*a*, 47*b* of the lower tray 46, and the tail end 57 of the latch arm 52 seats against stop block 59, to define the 'tray in' position of FIGS. 5*a* and 6*a*.

In another aspect, the support base 22 of the high chair 1 is provided with reversibly retractable means for transporting 70 the high chair 1 along a floor surface 5 of a type that is commonly made use of for kick-along library stools. That means may also be locked in a retracted position as will be described in more detail below.

Figure 9A:
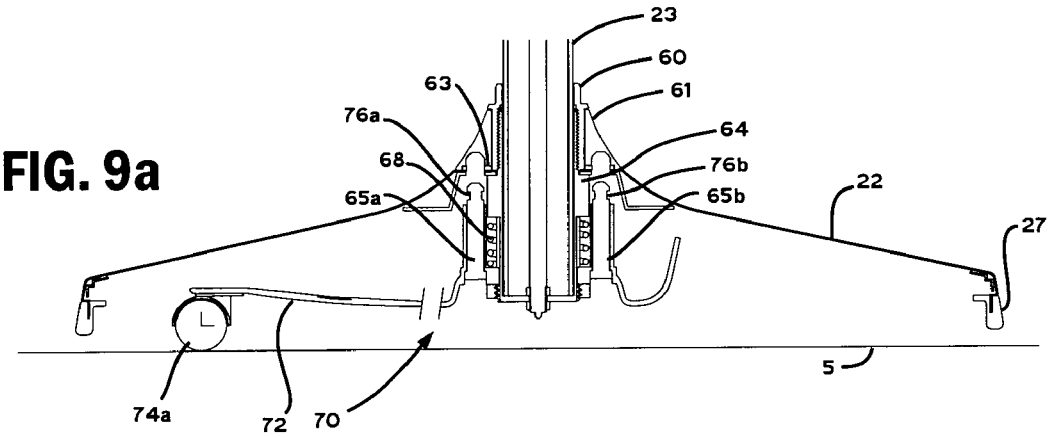
FIGS. 9*a* to 9*c* show sectional views of the support base of FIG. 8 with the retractable transport elements respectively in engagement with a floor surface; retracted from that floor surface; and retracted from the floor surface and locked in that retracted position.
Figure 9B:
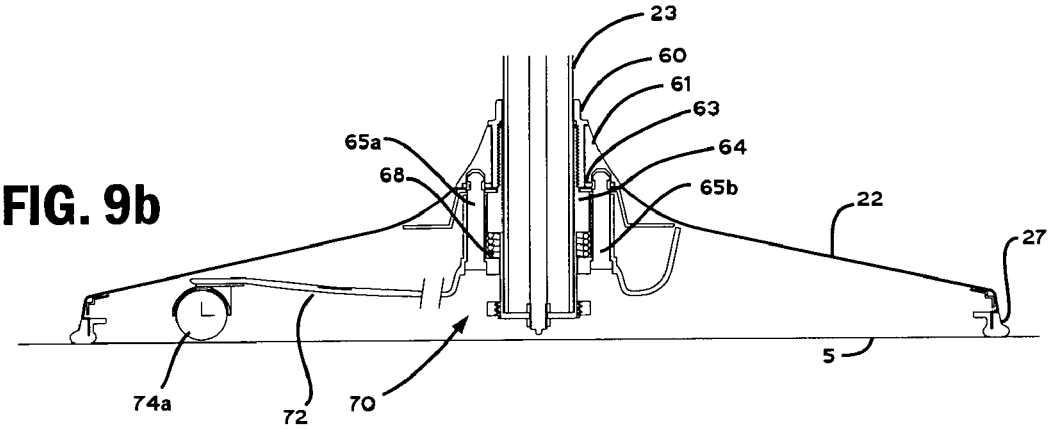
Figure 9C:
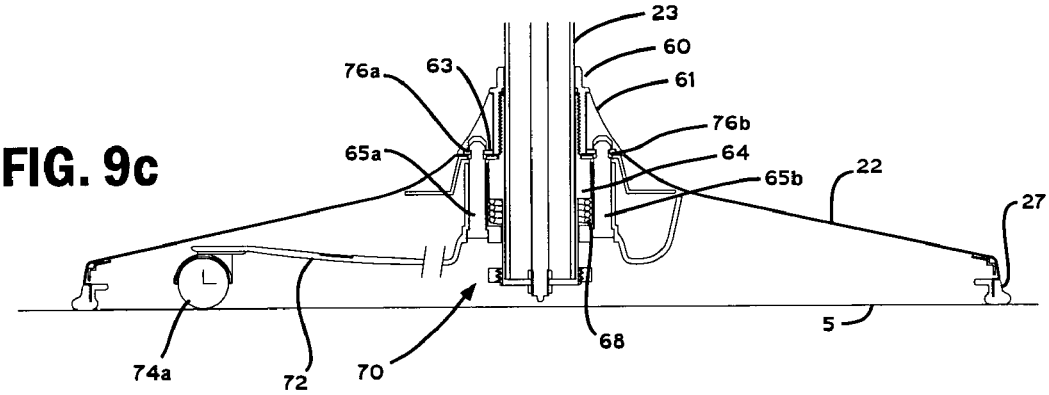

Thus, now referring also to FIGS. 8 to 9*c* the support base 22 may be seen to define a skirt-line form with a hollow interior and provided at the circumference thereof with a compressible rubber rim portion 27. The support base 22 attaches to the lower part 23 of the central support column 20 through central hole 29 and by means of upper sprung collar arrangement comprising inner collar 60, outer collar 61, light spring 62 and lock ring 63 which in combination comprise a retract lock mechanism. In turn, the support base 22 attaches to the reversibly retractable transport means 70 by means of a connector column 64, which mounts in spring-loaded relationship under the action of compression spring 68 to cruciform arm mounting 72 by means of bolts 65*a*, 65*b* that fix via fixing holes 66*a*, 66*b* of the arm mounting 72 to fixing holes 67*a*, 67*b* of the support base 22. The heads of the bolts 65*a*, 65*b* may also pass via tapered eye holes 78*a*, 78*b* through lock ring 63. Stop end-piece 69 fixes to the lower end of the connector column 64.

Overall, the effect is that the cruciform arm mounting 72 is movable up and down relative to the lower part 23 of the central support column 20 about an extent defined by the unthreaded midriff part 74 of the connector column. That up and down movement is subject to the biasing force of the compression spring 68 such that in the absence of any other applied force the cruciform arm mounting 72 is pushed away (i.e. down) the central support column 20. Each arm of the cruciform arm mounting 72 is provided with castors 74*a*, 74*b*, 74*c* (only three visible) and thus, a retractable means for transporting 70 the high chair 1 along a floor surface 5 is provided. That movement may also be locked by the lock mechanism 61, 62, 63 as described hereinafter.

In the absence of applied downward force to the high chair 1 and of any locking, the retractable transport means 70 adopt the configuration as shown in FIG. 9*a*. The compression spring 68 biases the cruciform arm mounting 72 downwards such that the castors 74*a-c* contact the floor surface 5. The support base 22 is thereby lifted up out of contact with the floor surface 5 and the high chair 1 as a whole may be pushed along the floor surface on the castors. When a downward force (e.g. resulting from the weight of a child placed in the seat 10) is applied, the force of the compression spring 68 is overcome and the retracted configuration of FIG. 9*b* is adopted. The outer compressible rubber rim 27 of the support base 22 comes into contact with the floor surface, is compressed and effectively acts as a brake to prevent any rolling action of the castors 74*a-c* and movement of the high chair 1 as a whole along the floor surface. It will be appreciated that for simplicity in FIGS. 9*a* and 9*b* only one arm and one castor 74*a* of the cruciform arm mounting 72 is shown.

The retractable transport means 70 may also be locked in the retracted position (i.e. of FIG. 9*b*) by use of the lock mechanism 61, 62, 63. In the locking position (as shown in FIG. 9*c*) the lock ring 63 is rotated by turning outer collar 61 under the control of light spring 62 such that nicks 76*a*, 76*b* provided near the heads of bolts 65*a*, 65*b* are engaged by the narrowed part of tapered eye holes 78*a*, 78*b* provided to the lock ring 63. Movement of the bolts 65*a*, 65*b* and hence, of the cruciform arm mounting 72 with castors 74*a-c* is thereby locked. To release the lock, the lock ring 63 is rotated back by turning outer collar 61 in the opposite sense, again under the control of light spring 62 such that the nicks 76*a*, 76*b* of the heads of bolts 65*a*, 65*b* disengage from the narrowed part of tapered eye holes 78*a*, 78*b* provided to the lock ring 63. The cruciform arm mounting 72 may then freely move up and down between the retracted position of FIG. 9*b* and transport position of FIG. 9*a* dependent only on the presence of any applied downward force.

Figure 10B:
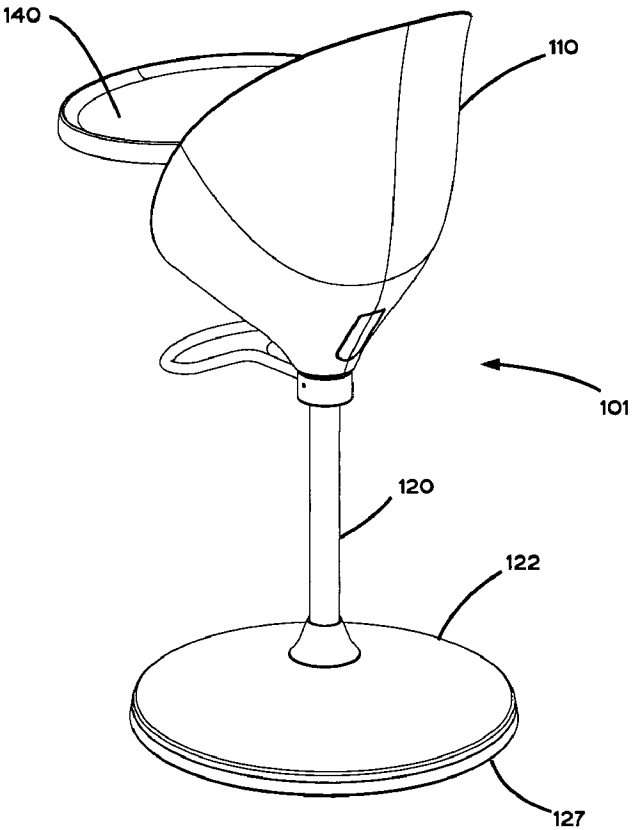
FIGS. 10*a* and 10*b* respectively show offset perspective views from the front and rear of a second high chair in accord with the present invention.
Figure 10A:
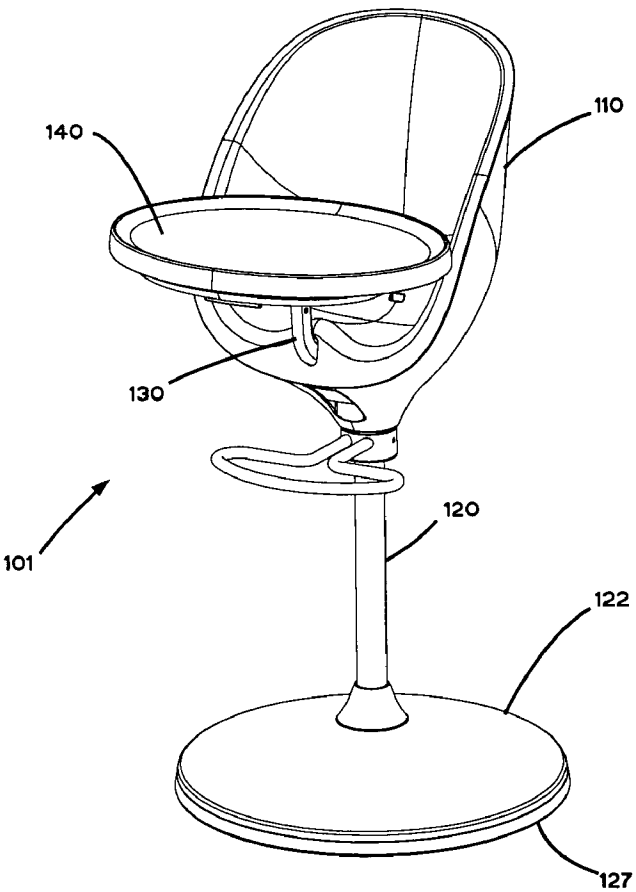

FIGS. 10*a* and 10*b* show a second high chair 101 herein that is a variant of the first high chair 1 of FIGS. 1 to 9*c*. The second high chair 101 has a seat 110, central post 130 and tray assembly 140 (i.e. everything from the lowest part of the seat 110 upwards) that is identical in form and function to that of the first high chair 1, and for succinctness these aspects are not again described in detail.

The second high chair 101 differs from the first high chair 1 in that the telescopic central column 20, 21, 23 thereof is replaced by a non-telescopic (i.e. fixed) column 120; and in that the transport arrangement 170 provided to the column base 122 is of an entirely different type. That transport arrangement 170 is described in detail hereinbelow.

Overall, it may thus be appreciated that the second high chair 101 represents a 'simplified' version (i.e. fixed central column 120; simpler transport arrangement 170) of the first high chair 101. In further simplifications, the removable tray 42 of the tray assembly 40 of the first high chair 1 may not be present; and/or the seat 10 rotation capability of the first high chair 1 may be removed by replacing the rotation mounting 24 thereof with a fixed mounting.

Figure 11:
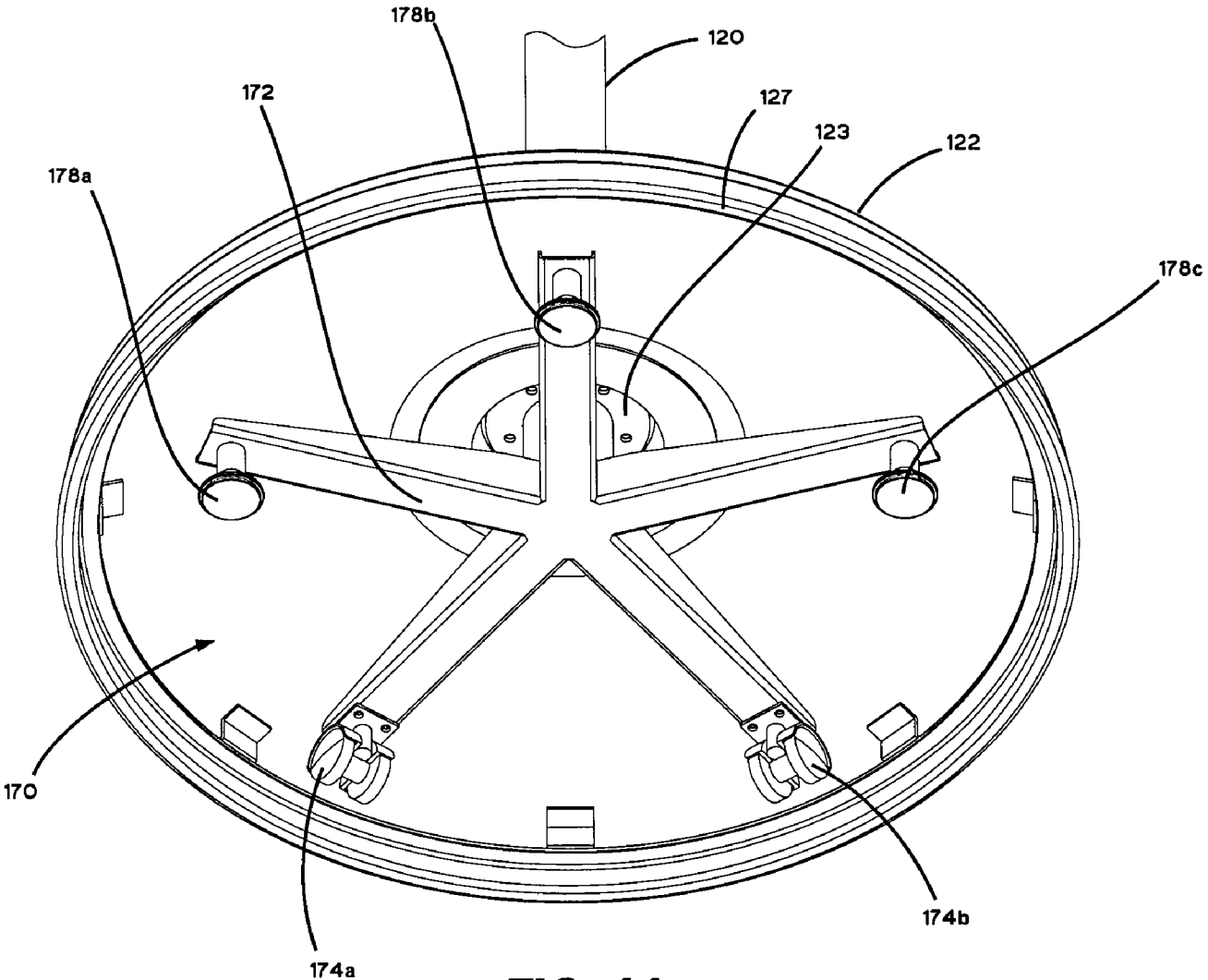
FIG. 11 shows a perspective view of the underside of the column support base with transport elements of the second high chair of FIGS. 10*a* and 10*b*.
Figure 12A:
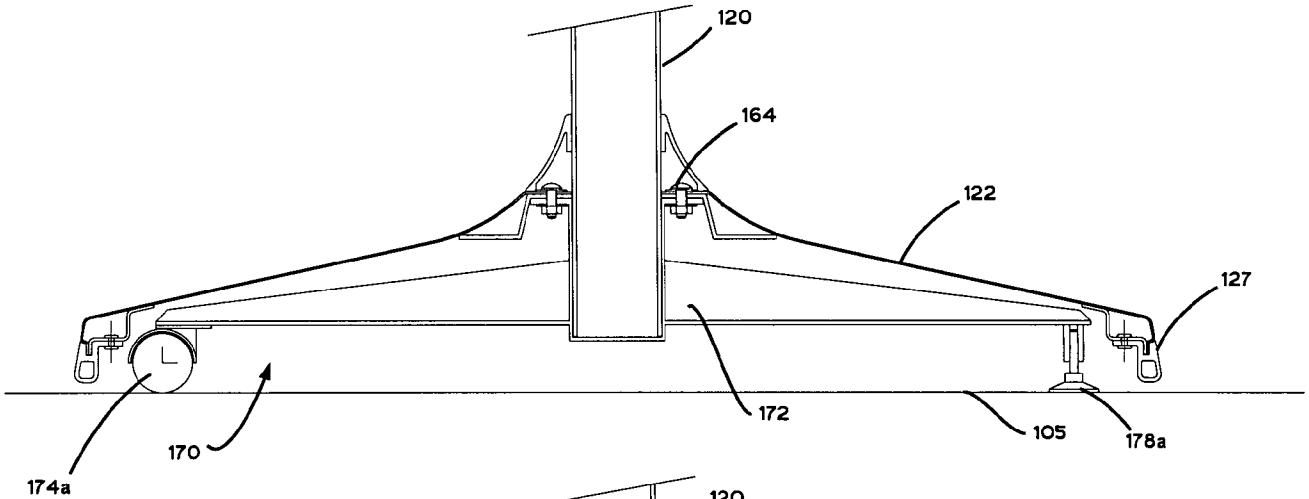
FIGS. 12*a* and 12*b* show sectional views of the column support base of FIG. 11 with the transport elements respectively in 'stop' and 'transport' positions.
Figure 12B:
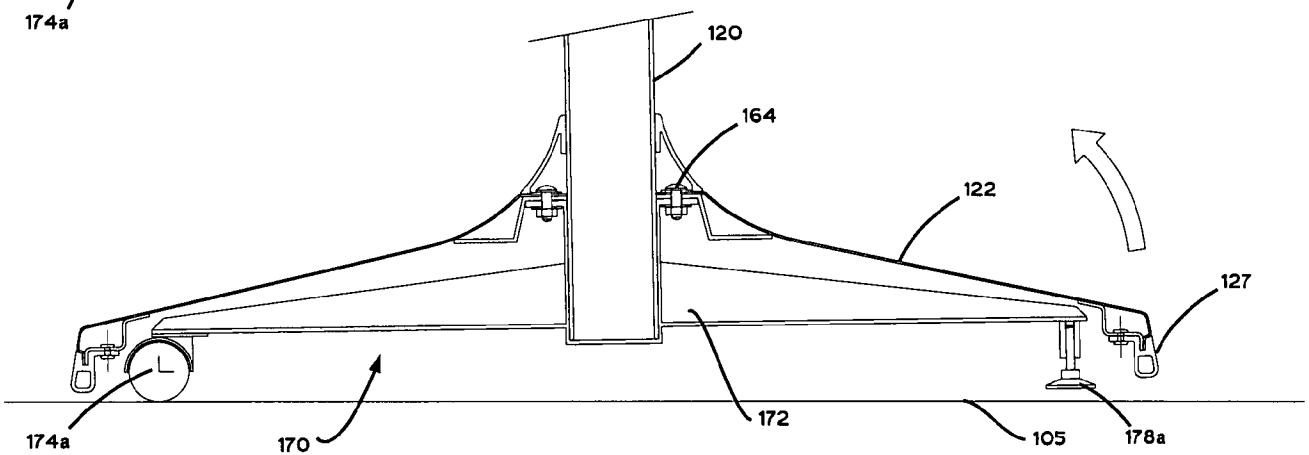

Turning now to FIGS. 11; 12*a* and 12*b*, a non-retractable transport arrangement 170 is seen to be fixed via circular bracket 164 to the underside of the column support base 122 of the second high chair 101 of FIGS. 10*a* and 10*b*. In more detail, the column support base 122 may be seen to define a skirt-line form with a hollow interior and provided at the circumference thereof with a rubber rim portion 127. Five armed mounting 172 fixedly attaches to the lower end of the support column 120. Two adjacent arms of the five armed mounting 172 are provided with pairs of castors 174*a*, 174*b*. The other three arms are provided with fixed feet 178*a*, 178*b*, 178*c*, which effectively act as a brake against rolling action of the castors 174*a*, 174*b* and movement of the high chair 101 as a whole along a floor surface 105 when in the normal use (i.e. 'stop') position as shown at FIG. 12*a*. To transport the second high chair 101, it must be first tipped up as shown at FIG. 12*b* such that it rests only on the castors 174*a*, 174*b* (i.e. the feet 178*a-c* are off the floor surface 105). The chair 101 may then be rolled about on the castors 174*a*, 174*b* to the desired floor position.

The application of which this description and claims form part may be used as a basis for priority in respect of any subsequent application. The claims of such subsequent application may be directed to any feature or combination of features described therein. They may take the form of product, method or use claims and may include, by way of example and without limitation, one or more of the following claims:

The invention claimed is:

1. A high chair for seating of an infant or toddler comprising a seat, said seat including a seat base portion and a seat backrest portion;

a support for supporting the seat in a raised position relative to a floor surface;

a central post projecting away from said seat base portion, said central post having an upper end; and mounting to said upper end of the central post, a tray assembly including a tray horizontally movable backwards and forwards relative to the seat, wherein the central post mounts to the seat or to the support by an adjustable central post mounting that allows for adjustment of the position of the upper end of the central post relative to the seat.

2. A high chair according to claim 1, wherein the seat base portion is planar and the seat backrest portion extends upwards from a back edge thereof.

3. A high chair according to claim 1, wherein the seat is of bucket seat form.

4. A high chair according to claim 1, wherein the support comprises a frame structure having supporting legs.

5. A high chair according to claim 1, wherein the support comprises a central upright support column provided at a lower end thereof with a column base.

6. A high chair according to claim 1, wherein the seat movably mounts to the support for relative movement of the seat relative to the support.

7. A high chair according to claim 6, wherein the seat rotatably mounts to the support.

8. A high chair according to claim 6, wherein a seat lock mechanism is provided to enable reversible locking of said relative movement of the seat relative to the support.

9. A high chair according to claim 1, wherein the support provides for upwards and downwards movement of the seat relative to the floor surface.

10. A high chair according to claim 9, wherein the support includes an extension mechanism that enables reversible extension thereof to allow for said upwards and downwards movement of the seat relative to the floor surface.

11. A high chair according to claim 9, wherein the support comprises a central upright support column that is provided at its lower end thereof with a column base, and said central upright support column has telescopic form such that it is telescopically extendable.

12. A high chair according to claim 11, wherein said telescopic central upright support column is provided with a gas pump for providing pumped gas propulsion to assist with the upwards movement thereof.

13. A high chair according to claim 9, wherein a support lock mechanism is provided to enable reversible locking of the upwards and downwards movement of the seat relative to the floor surface.

14. A high chair according to claim 1, wherein the support is provided at a lower end thereof with transport elements for transporting said lower end along a floor surface.

15. A high chair according to claim 14, wherein said transport elements are selected from the group consisting of sliders, rollers, wheels and castors.

16. A high chair according to claim 14, wherein the transport elements are provided with retraction means arranged such that the transport elements are reversibly retractable from a contact position in which they make transporting contact with the floor surface to a retracted position in which transporting contact with the floor surface is hindered or prevented.

17. A high chair according to claim 16, wherein the retraction means and/or brake are arranged such as to prevent transporting movement when downward force is applied to the seat and to allow such transporting movement in the absence of such downward force.

18. A high chair according to claim 14, wherein the transport elements are provided with a brake.

19. A high chair according to claim 1, wherein the central post projects both forwardly and upwardly from the seat base portion.

20. A high chair according to claim 1, wherein the central post mounts to the seat.

21. A high chair according to claim 1, wherein the central post mounts to the support.

22. A high chair according to claim 1, wherein the central post defines a curving form.

23. A high chair according to claim 1, wherein the tray defines a tray back edge that in use, locates close to the seated child.

24. A high chair according to claim 23, wherein said tray back edge has a curved form.

25. A high chair according to claim 1, wherein the tray is laterally movable relative to the seat from a child receiving position, in which the tray is moved laterally forwards such as to define sufficient space between the seat, central post and tray for placing of the child in a seated position in the seat, to a child retaining position, in which the tray is moved laterally backwards such as to sufficiently reduce the space between the seat, central post and the tray that the child is retained in its seated position in the seat.

26. A high chair according to claim 1, wherein the tray assembly comprises a slide mounting for slidably mounting the tray to the upper end of the central support post.

27. A high chair according to claim 26, wherein said slide mounting for the tray is provided with a tray lock mechanism to enable reversible locking of that sliding movement.

28. A high chair according to claim 27, wherein said tray lock mechanism enables locking of the tray in the child retaining position.

29. A high chair according to claim 26, wherein the slide mounting for the tray is provided with biasing means for biasing the tray to the child receiving position.

30. A high chair according to claim 1, wherein the tray assembly comprises a tray support and a fixed mounting for fixedly mounting said tray support to the upper end of the central support post, wherein the tray support is provided with a slide mounting for slidably mounting the tray thereto.

31. A high chair according to claim 1, wherein the central post mounting allows for forwards/backwards adjustment of the position of upper end of the central post relative to the seat.

32. A high chair according to claim 1, wherein the central post mounting allows for upwards/downwards adjustment of the position of upper end of the central post relative to the seat.

33. A high chair according to claim 1, wherein the central post extends from the central post mounting at an angle to the vertical, thereby enabling both upwards/downwards and forwards/backwards of the position of upper end of the central post relative to the seat.

34. A high chair according to claim 1, wherein the adjustable central post mounting is provided with a central post lock mechanism to enable reversible locking of said adjustment movement.

35. A high chair according to claim 1, wherein a seat insert is provided to the seat base portion and/or the seat backrest portion.

36. A high chair according to claim 1, wherein an adjustable leg rest is provided to the support for supporting the legs of a child when seated in the seat.

37. A high chair for seating of an infant or toddler comprising a seat, said seat including a seat base portion and a seat backrest portion;

a support for supporting the seat in a raised position relative to a floor surface;

a central post projecting away from said seat base portion, said central post having an upper end; and mounting to said upper end of the central post, a tray assembly including a tray and a slide mounting for said tray that enables horizontal movement of the tray backwards and forwards relative to the seat, wherein said slide mounting for the tray is provided with biasing means for biasing the tray forwards relative to the seat.

38. A high chair according to claim 37, wherein the tray is horizontally movable relative to the seat from a child receiving position, in which the tray is moved laterally forwards such as to define sufficient space between the seat, central post and tray for placing of the child in a seated position in the seat, to a child retaining position, in which the tray is moved laterally backwards such as to sufficiently reduce the space between the seat, central post and the tray that the child is retained in its seated position in the seat.

39. A high chair according to claim 37, wherein the tray assembly comprises a slide mounting for slidably mounting the tray to the upper end of the central support post.

40. A high chair according to claim 37, wherein the tray assembly comprises a tray support and a fixed mounting for fixedly mounting said tray support to the upper end of the central support post, wherein the tray support is provided with a slide mounting for slidably mounting the tray thereto.

41. A high chair according to claim 37, wherein said slide mounting for the tray is provided with a tray lock mechanism to enable reversible locking of sliding movement.

42. A high chair according to claim 41, wherein said tray lock mechanism enables locking of the tray in the child retaining position.

* * * * *